United States Patent [19]

Klein

[11] 4,062,093

[45] Dec. 13, 1977

[54] APPARATUS FOR TEXTURIZING FLOCKED FABRIC

[75] Inventor: Charles Klein, Mexico City, Mexico

[73] Assignee: United Merchants and Manufacturers, Inc., New York, N.Y.

[21] Appl. No.: 667,555

[22] Filed: Mar. 17, 1976

Related U.S. Application Data

[62] Division of Ser. No. 299,910, Oct. 24, 1972, Pat. No. 3,961,115.

[51] Int. Cl.[2] ..... D06C 23/02

[52] U.S. Cl. ..... 26/2 R; 26/25; 26/27; 28/160; 118/44; 118/102

[58] Field of Search ..... 26/2 R, 25, 26, 27, 26/30, 31; 428/88, 90; 28/72 P, 74 P, 76 P; 427/200, 206, 359, 368; 118/44, 102

[56] References Cited

U.S. PATENT DOCUMENTS

| | | | |
|---|---|---|---|
| 376,994 | 1/1888 | Tachon | 26/27 |
| 415,009 | 11/1889 | van den Esch | 26/2 R |
| 1,153,173 | 9/1915 | Steiner | 26/30 |
| 2,020,698 | 11/1935 | Platt | 28/76 P X |
| 2,187,543 | 1/1940 | Haskin | 26/25 X |
| 2,466,348 | 4/1949 | Ambye | 26/31 |
| 2,563,259 | 8/1951 | Miller | 117/9 |
| 2,590,713 | 3/1952 | Libbey | 26/2 R UX |
| 3,191,258 | 6/1965 | Spencer | 26/2 R X |
| 3,917,883 | 11/1975 | Jepson | 428/90 X |

FOREIGN PATENT DOCUMENTS

| | | | |
|---|---|---|---|
| 688,778 | 5/1930 | France | 26/25 |
| 62,092 | 5/1892 | Germany | 26/27 |
| 87,208 | 6/1896 | Germany | 26/27 |
| 14,089 of | 1887 | United Kingdom | 26/2 R |

*Primary Examiner*—Robert R. Mackey
*Attorney, Agent, or Firm*—Michael A. Caputo

[57] ABSTRACT

An apparatus for texturizing a flocked fabric comprising a flock fabric delivery station; a flock fabric receiving station; means for conveying the flock fabric from the delivery station to the receiving station; and means for orienting the flocked fabric comprising, a plurality of flexible beaters connected to means for bringing the beaters into continuous and vigorous contact with the flock side of the fabric, means for wetting the fabric prior to its being contacted by the beaters, and means for drying the fabric subsequent to its being contacted by the beaters.

3 Claims, 14 Drawing Figures

FIG. 3A.
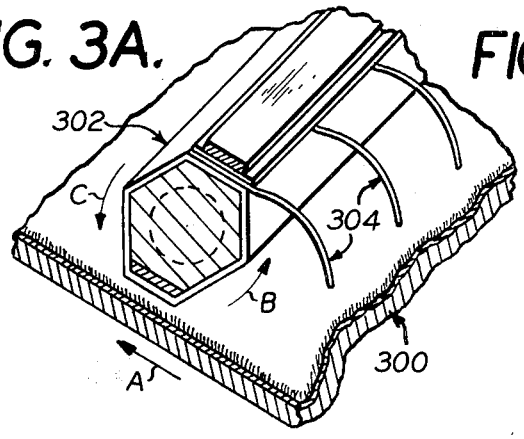
FIG. 4A.
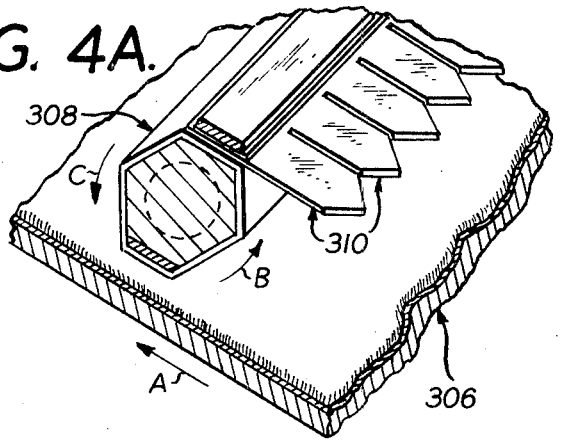
FIG. 5A.
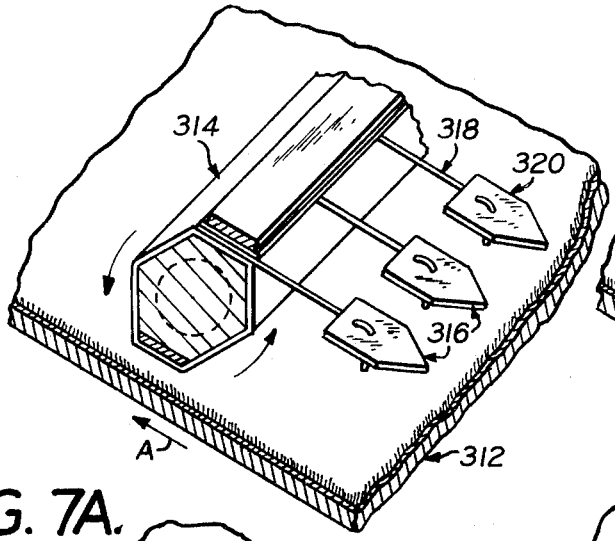
FIG. 6A.
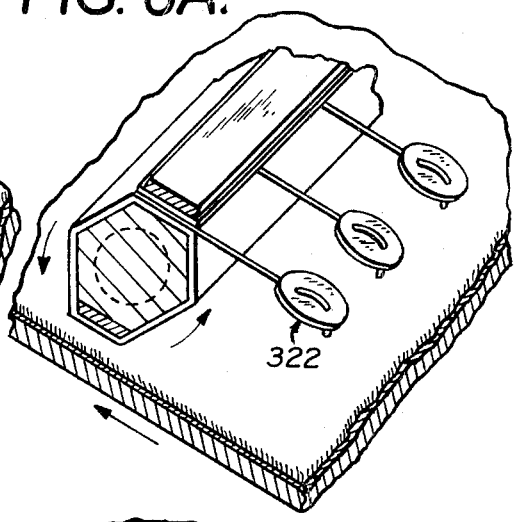
FIG. 7A.
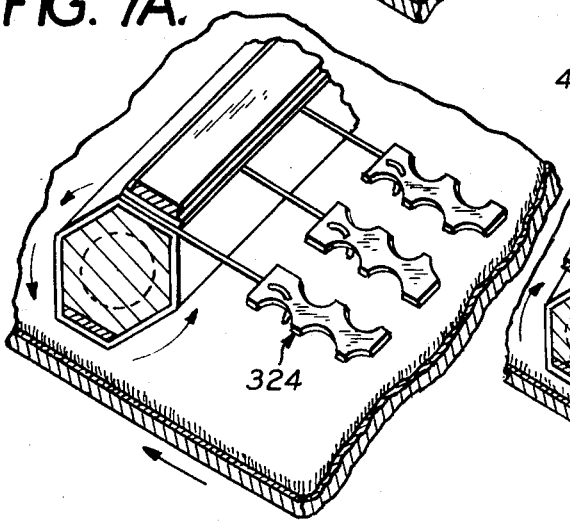
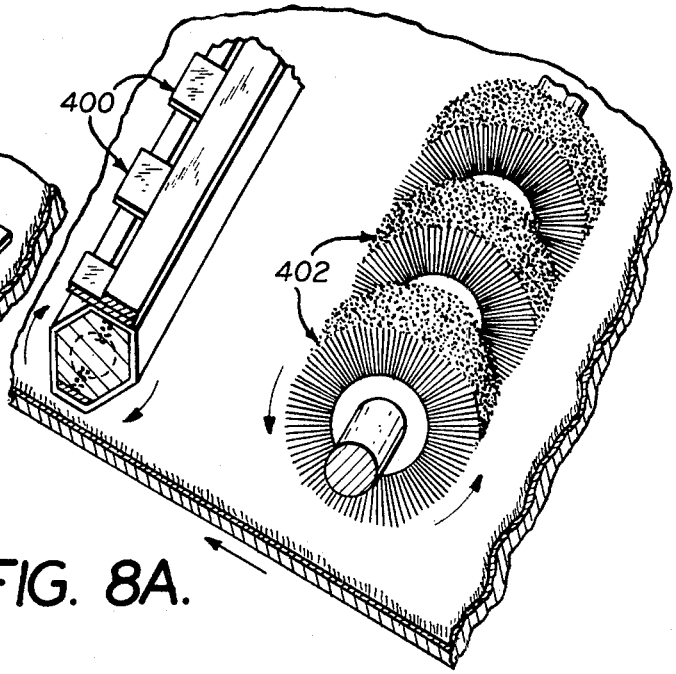
FIG. 8A.

APPARATUS FOR TEXTURIZING FLOCKED FABRIC

CROSS REFERENCE TO RELATED APPLICATIONS

This application is a division of copending application Ser. No. 299,910, filed Oct. 24, 1972, now U.S. Pat. No. 3,961,115 granted June 1, 1976.

BACKGROUND OF THE INVENTION

1. Field of the Invention

This invention pertains to the field of flocked fabrics. More particularly, this invention pertains to the field of methods for creating novel texturized or patterned effects in flocked fabrics.

2. Description of the Prior Art

Flocked fabrics consisting of a backing layer, a flock adhesive interlayer and a top layer of flocked material are well known. Methods for preparing such fabrics are well known. (See for example, U.S. Pat. No. 3,079,212, incorporated herein by reference).

Additionally known are methods for imparting unusual designs or texturized patterns into the flock by physical means such as by printing with a gravure or relief type printing roll. Generally, however, it is difficult to maintain such designs in flock fabric and additionally, the type of designs which can be obtained are relatively limited.

SUMMARY OF THE INVENTION

I have discovered a new method and apparatus for imparting unusual and novel texturized or patterned effects to flock fabrics. More particularly I have discovered a new method for texturizing a flock fabric which comprises wetting at least the flock portion of the fabric and orienting the flock in a pre-determined design pattern by continuously and rapidly contacting the flock side of the fabric with a plurality of flexible beaters having pre-selected shapes and then drying the fabric.

Additionally, the present invention comprises an apparatus for carrying out the foregoing process. This apparatus comprises a flock fabric delivery station; a flock fabric receiving station; means for conveying a flock fabric from the delivery station to the receiving station in flat form; orientation means disposed between the stations comprising a plurality of flexible beaters and means for bringing the beaters into continous and vigorous contact with the flock side of the fabric while the fabric is being conveyed from one station to the other; means for wetting the flocked fabric disposed between the delivery station and the orientation means; and means for drying the fabric subsequent to its being contacted by the beaters.

DESCRIPTION OF THE DRAWINGS

FIG. 3A is a sectional detail view of part of the present invention.

FIG. 4A is a view similar to that of 3A of yet another embodiment of the invention.

FIG. 5A is a view similar to 3A of yet another embodiment of the invention.

FIG. 6A is a view similar to FIG. 3A of yet another embodiment of the invention.

FIG. 7A is a view similar to FIG. 3A of yet another embodiment of the invention.

FIG. 8A is a view similar to FIG. 3A of yet another embodiment of the invention.

DESCRIPTION OF THE PREFERRED EMBODIMENT

Figure 1:
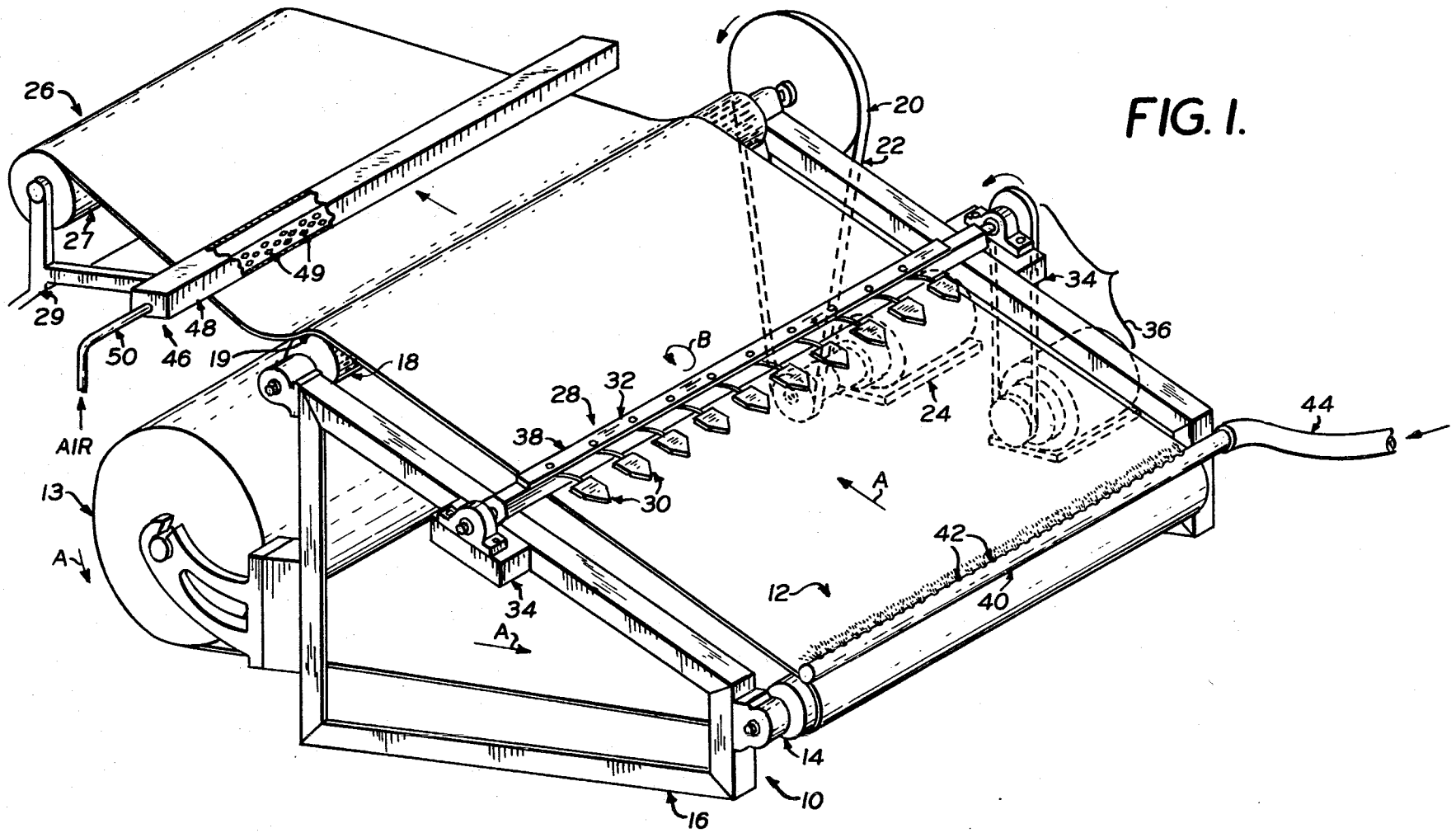
FIG. 1 is a view, in perspective, of the present invention.

Referring to the drawings and in particular FIG. 1, the apparatus of the present invention is shown generally at 10. Shown at 12 is a flocked fabric which is moving in the direction indicated by arrows A. Fabric 12 is being fed to apparatus 10 from a delivery station 13 which is a take-off rotatably mounted on the fabric support stand 16. A non-driven guiding roller 14 is rotatably mounted in stand 16 about which fabric 12 goes through about a 130° wrap. Conveying roller 18 is a driven roll which has a driving disc 20 attached to the end thereof for connection via belt 22 to motor 24. Guide roll 18 has grabbing means, e.g., upstanding pins 19, for temporarily grabbing the fabric 12 and pulling it from roll 13, and thence conveying the fabric from delivery station 13 to a receiving station 26 which comprises a driven take-up roll 27 rotatably mounted in stand 29.

Mounted approximately mid-way between delivery station 13 and receiving station 26, on stand 16, is a flock orientation means designated generally as 28. Orientation means comprises a plurality of flexible beaters 30 which are attached to a contacting means. The contacting means 32 is a driven roll 32, rotatably mounted on stand 16 by use of brackets 34 and which is driven by use of drive means designated generally as 36. Roll 32 rotates in the direction indicated by arrow B.

As can be seen, roll 32 is disposed across the widthwise direction of the fabric and is mounted slightly above the fabric. Roll 32 is adapted for bringing flexible beaters 30 into vigorous and continuous contact with fabric 12 as it travels from delivery station 13 to receiving station 26.

Flexible beaters 30 are secured to roll 32 by use of a clamp 38 which is attached to roll 32.

Figure 3B:
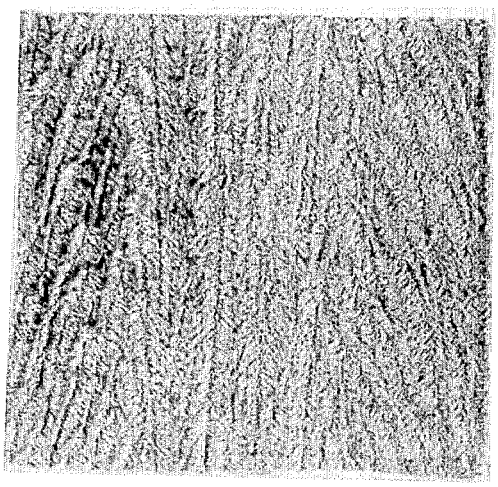
FIG. 3B is a picture of the product obtained using the embodiment of FIG. 3A.

Flexible beaters 30 may be of two different types, depending on the design which it is desired to impart to the flocked fabric. The first type of flexible beater is that composed of a single piece member which is sufficiently long and flexible to be capable of a whip-like action when rotated rapidly by roll 32. Such a beater is shown in FIG. 3A, which depicts fabric 300 travelling in the direction indicated by arrow A with contacting roll 302 having single piece flexible beaters 304 attached thereto. Roll 302 rotates in the direction indicated by arrows B and C. As shown, beaters 304 consists of relatively heavy monofilaments of a synthetic nature, such as, nylon and the like. These beaters are, however, sufficiently thin such that as wheel 302 rotates rapidly, the end portions of beaters 304 continually whiplash the flocked portion of the fabric. The effect obtained with a beater of the type depicted by 304 is shown in FIG. 3B.

Figure 4B:
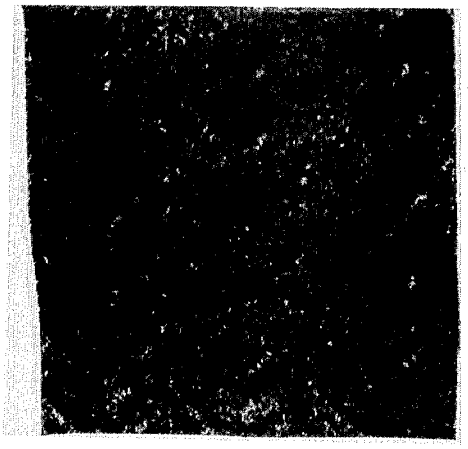
FIG. 4B is a picture of the product obtained using the embodiment of FIG. 4A.

Another type of single piece or single component beater is shown in FIG. 4A. Here fabric 306 is shown travelling in the direction of arrow A and roll 308 is rotating in the direction indicated by arrows B and C. Beaters 310 are composed of a flexible material such as heavy rubber, nylon, plastic, etc. The end portions of beaters 310 can have any type shape, but generally such beaters can be characterized by virtue of their exerting a flapping type contact with the fabric. Understandably, if beaters 310 were sufficiently long, the type action which they impart to the fabric by virtue of their being rapidly rotated could also be described as a whiplash type of action. The type of fabric designed which is obtained by a beater such as 310 is shown in FIG. 4B.

The second type of beater used in the apparatus in the present invention consists of two components. Examples of such beaters are shown in FIGS. 5A, 6A, and 7A. Referring to FIG. 5A, fabric 312 is shown travelling in the direction indicated by arrow A. Beaters 316 are secured to roll 314 and consists of two components. The first component 318 is a flexible connecting member which is capable of whip-like action. Typically, such a member may be a relatively heavy monofilament of nylon or other synthetic. The second component 320 is a flock contacting member which may be shaped in any pre-selected design depending on the pattern which it is desired to impart to the fabric. The second component or flock contacting member 320 is attached to the other end of connecting member 318 by a knot or adhesive. Typically, contacting member 320 is also composed of a flexible material, such as, rubber or synthetic which can withstand the repeated contact with the fabric.

Depending on the shape of the contacting member, the design imparted to the flocked portion of the fabric can be varied in an infinite number of ways. It is understood, therefore, that the important factor with regard to the present invention is the presence of a beating or flock contacting member which can be brought into rapid, continuous and vigorous contact with the flocked fabric. Thus, for example, referring again to FIG. 3A, if a knot were put into the end of each of beaters 304, an entirely different design would be obtained in the fabric.

Figure 5B:
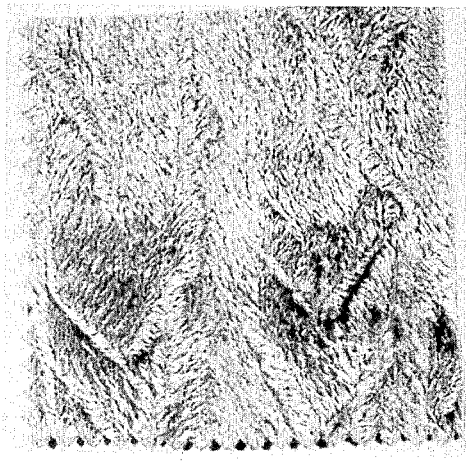
FIG. 5B is a picture of the product obtained using the embodiment of FIG. 5A.
Figure 6B:
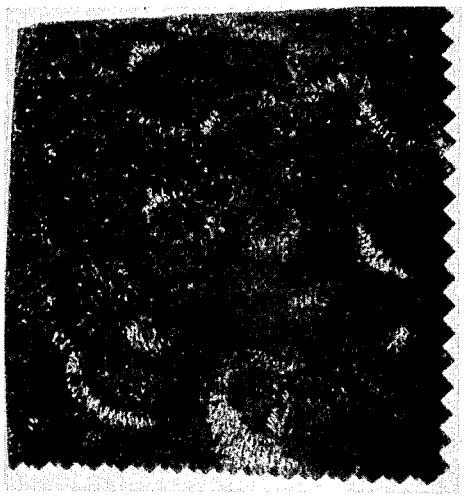
FIG. 6B is a picture of the product obtained using the embodiment of 6A.
Figure 7B:
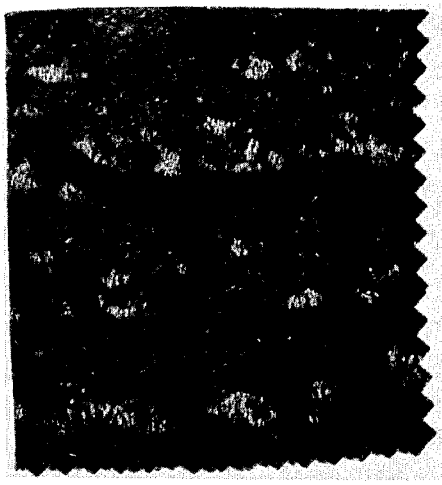
FIG. 7B is a picture of the product obtained using the embodiment of FIG. 7A.

FIGS. 6A and 7A show views essentially identical to that of 5A, the only difference being in the design of the flock contacting member. Thus, in FIG. 6A, the flock contacting member 322 is in the shape of a circular button whereas in FIG. 7A, flock contacting members 324 have a scalloped design. The design patterns obtained with the flock contacting members of FIG. 5A, 6A and 7A are shown in FIGS. 5B, 6B, and 7B, respectively.

Disposed between orientation means 28 and delivery station 13 is a spraying head 40 having apertures or spray nozzles 42 therein. Spraying means 40 is adapted for providing uniform wetting of the fabric prior to its passing orientation means 28. Water or the desired wetting agent is supplied to spray nozzles 40 through supply line 44 which can be connected to any source of liquid, not shown.

Disposed between conveying roll 18 and take-up roll 27 is fabric drying means designated generally as 46. Drying means 46 comprises an air distribution chamber 48 positioned above and in relatively close proximity to the fabric having an air inlet 50 which is connected to a source of air, not shown. Air distribution chamber has a multiplicity of perforations in the bottom thereof adapted to force the drying stream of air onto fabric 12. Understandably, other types of well known and conventional drying means such as, for example, a drying chamber, may be used to dry the fabric prior to its being wrapped on take-up roll 27.

In conjunction with the apparatus described hereinabove, the present invention further comprises a method for texturizing a flocked fabric comprising first wetting at least the flocked portion of the fabric and then subjecting the flock to an orientation step in order to orient the flock in a pre-determined design pattern by continuously, vigorously, and rapidly contacting the flocked side of the fabric with a plurality of flexible beaters having pre-selected shapes; and then drying the fabric.

Any type of flocked fabric is suitable for use in the process of the present invention. The fabric speed may vary from about 3 feet per minute to 90 feet per minute and preferably is 60 to 90 feet per minute. The speed of rotation of the flocked contacting roll may generally vary between about 850 to 2200 rpm. Understandably, the relative speeds of the fabric and the roll, i.e., beaters can be varied over a wide range and by such variation the repetition of the design pattern on the fabric can be changed as desired. Of course, the contacting roll must be rotated with sufficient speed so as to bring the beaters into vigorous contact with the flock fabric. If the roll speed is too slow, then the intensity of the whip-like action will not be sufficient to impart a design to the flock fabric.

The flock fabric may be wetted either with water or with an aqueous mixture of water and a finish or resin. Many types of finishing resins are known to the art, such as, resins which will impart soil resistance to the fabric, wrinkle resistance to the fabric, or which upon drying will assist in stabilizing or increasing the permanence of the design pattern.

Typical resins include a cellulose reactant aminealdehyde compound selected from the group consisting of melamine formaldehyde resin, triazine urea formaldehyde resin, dimethylolethylene urea, alkyl-methylol-hydroxyethylene urea, dimethylol dihydroxy ethylene urea, dimethylol formamide, dimethylol methyl carbamate, dimethylol methoxyethyl carbamate, dimethylol diaminoanthraquinone, dimethylol ethyl carbamate, dimethylol n-propyl carbamate, dimethylol acetamede, bis methoxy methylethylene urea, dimethylol hydroxyalkyl carbamate, dimethylol diaminochlorobenzene sulfonic acid, dimethylol N-hydroxyalkyl triazone, dimethylol propylene urea, bischloromethyl ethylene urea, N,N'-methylene bis acrylamide, dimethylol urea paste, dimethoxy methyluron, dimethylol 5-hydroxy propylene urea, 1-amino-3-chloro-propanol, diemthylol 4-methoxydimethyl propylene urea, methoxymethylol hydroxyethyl triazone and mixtures thereof.

The foregoing resins are usually combined with suitable catalysts as are well known in the art. The dry add-on of such resins is preferably in the range from about 1 to 10%.

The amount of wetting solution, whether it be water or water containing an added ingredient as described hereinabove which is sprayed on the fabric should be that amount sufficient to completely wet the fabric. This wetting can include both the flock as well as the substrate and/or binder. Understandably, it is not desirable to wet the fabric so that it is dripping wet inasmuch as the additional water will make the operation somewhat messy. Of course, if insufficient water is used, it will be that much more difficult to impart the design to the flocked fabric. In any case, the amount of water used is easily determined during the process.

Another embodiment of the process of the present invention provides a method for achieving a slightly different type of patterned effect in a flock fabric. Particularly, this method comprises first wetting at least the flock portion of the fabric and then orienting the fabric in spaced-apart rows in a single direction by contacting the flock with a plurality of radial brushes. The flock in the alternating rows created by the spaces between the spaced-apart rows is oriented in the opposite direction by a series of flat-edge flexible beaters so as to produce a high degree of definition between the alternate rows and the spaced-apart rows.

Figure 2:
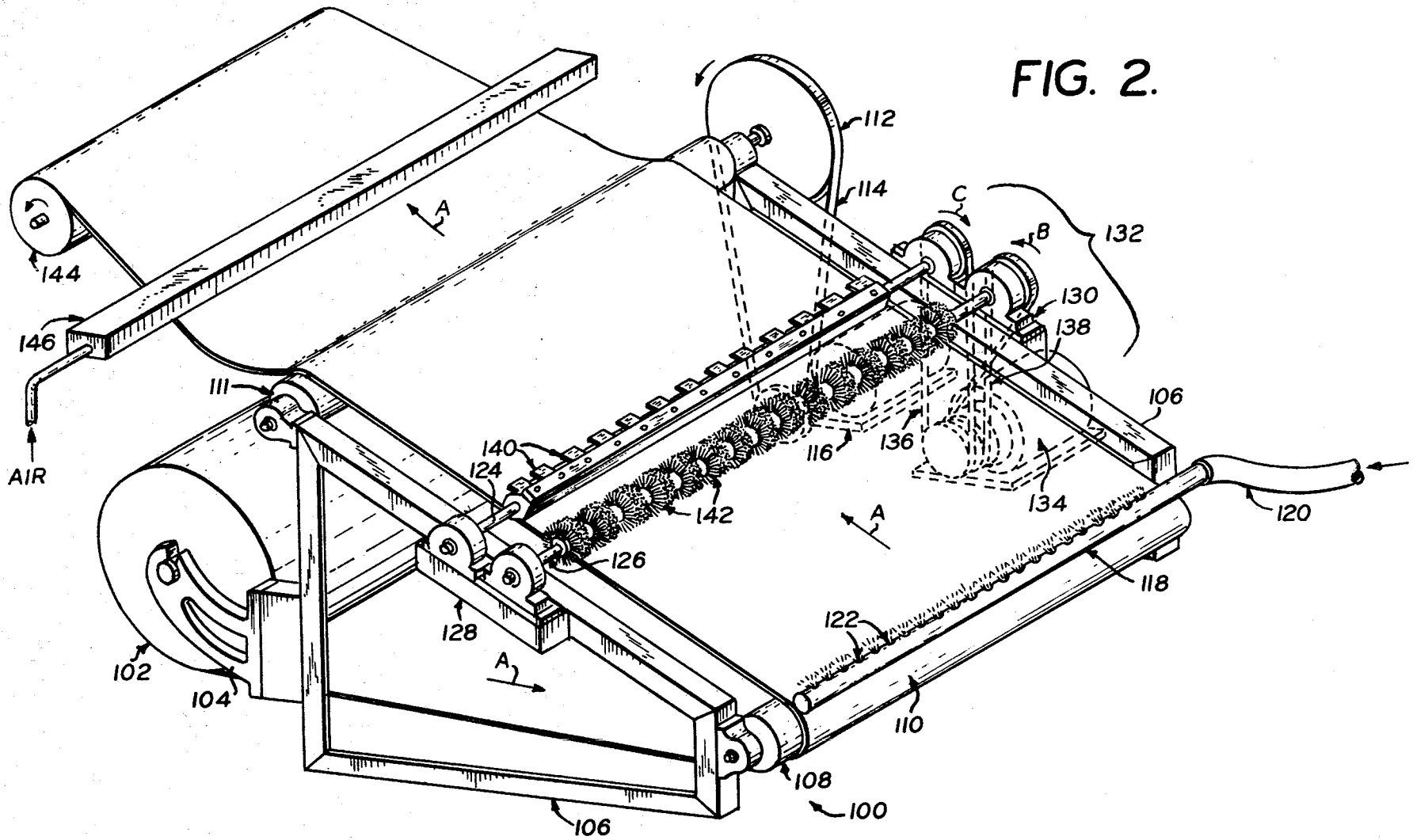
FIG. 2 is a view similar to FIG. 1 of another embodiment of the invention.

Referring now to FIG. 2, an apparatus for carrying out the above embodiment of the present invention is shown. This embodiment of the invention comprises an apparatus shown generally at 100 which comprises a flock fabric delivery station consisting of a take-off roll 102 of the fabric rotatably mounted in bracket 104. Bracket 104 is attached to supporting stand 106. Rotatbly mounted in supporting stand 106 is guide roll 108 about which fabric 110 goes through about a 130° wrap. Rotatably mounted above delivery station 102 is a driven conveying roll 111 which is driven by use of flange 112, drive belt 114 and motor 116. Conveying roll 111 has a grabbing type surface, shown as upstanding pins which serve to catch the fabric from the bottom side and, by rotation of roll 111, move the fabric in the direction of arrow A.

Mounted above guide roll 108 is spraying tube 118 which is connected to a source of water or spray solution 120. Spraying tube 118 contains a plurality of spray nozzles or apertures therein designated as 122 through which the liquid is dispensed onto the fabric passing said spray tube.

Disposed between conveying roll 110 and spray tube 118 are two driven rolls 124 and 126 which are mounted in brackets 128 and 130 attached to support stand 106. Each of these rolls is driven by drive means designated generally as 132 which comprises a motor 134 and appropriate belt drive systems 136 and 138. The motor 134 is connected by belt drive systems 136 and 138, respectively, to rolls 124 and 126 so that these rolls turn in opposite directions to one another. Moreover, roll 126 is rotated in the direction indicated by arrow B which is the same direction as conveying roll 111. The rotation of roll 124 is shown by arrow C.

Roll 124 has a plurality of flat edged, flexible beaters secured thereto in spaced apart relationship to one another. The flexible beaters are arranged along the longitudinal axis of roll 124. Beaters 140 may be composed of any flexible type material such as rubber, nylon, etc. which can withstand the vigorous contacting with fabric 110.

Roll 126 which is disposed parallel to and adjacent to roll 124 between wetting means 122 and roll 144 serves as an axle for a series of spaced-apart rotary brushes 142. The relationship between the position of each rotary brush along roll 126 is such that it is positioned exactly opposite to a space created by two of the flexible beaters 140. Moreover, the width of the rotary brush is equal to the opposing space. Consequently, those widthwise rows of the flocked fabric which are contacted by beaters 140 are not contacted by rotary brushes 142. As can be seen, rotary brushes 142 rotate in a direction opposite to that of beaters 140. Additionally, while shown in FIG. 2, the width of the brushes and the width of the beaters are identical, it is possible to use beaters and brushes of varying widths. It is only important that the width of the space opposite the brush is equal to the width of the opposing brush. Inherently, the width of the space between two brushes will be equal to the width of the opposing beater.

Apparatus 100 further comprises a fabric receiving station 144 composed of a driven take-up roll for wrapping the treated fabric.

Disposed between roll 111 and the fabric receiving station 144 is a drying means designated as 146. As shown, the drying means constitutes an air blower similar to that designated at 46 in FIG. 1 adapted for uniformly distributing a drying air flow across the fabric. Of course, other means for drying the fabric can be used, such as, for example, a heated box through which the fabric is conveyed, etc.

Brushes 142 and beaters 140 are disposed at an appropriate distance from the fabric such that the brushes 142 come into sufficient contact with the flock to orient that portion of the flock which the brushes contact in the direction of rotation of the brushes. In the same way, beaters 140 contact the flock and orient that portion of the flock contacted in a direction opposite to that flock which was oriented by the brushes.

By virtue of the use of the sequential brushing of given widthwise segments of the flock and the beating, in the opposite direction of the next adjacent widthwise segments of the flock, an extremely high degree of definition is obtained between the alternately brushed and beaten segments. Thus, I have found, for example, that if beaters 140 were replaced by a second series of rotary brushes, the degree of definition obtained in the resulting fabric does not produce a satisfactory result. It should be noted, however, that it is not critical as to whether the brushes or beaters come first relative to the direction of fabric travel. That is to say, the positions of rolls 126 and 124 could be reversed and the same effect achieved.

Figure 8B:
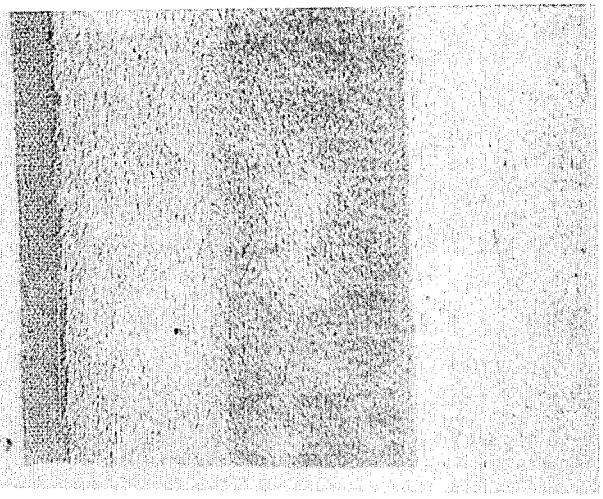
FIG. 8B is a picture of the product obtained using the embodiment of FIG. 8A.

FIG. 8A is a detailed perspective view of the relationship of spaced beaters 400 and spaced rotary brushes 402. FIG. 8B illustrates the effect obtained by the use of the alternate brushing and beating.

Variations can, of course, be made without departing from the spirit and scope of the invention.

Having thus decided my invention what I desire to secure and claim by Letters Patent is:

1. An apparatus for texturizing a flocked fabric comprising:

a. means for continuously feeding a flocked fabric from a source of supply such that the flocked fabric lies in a single plane;

b. means for wetting the flocked portion of the fabric with a liquid while the fabric is moving;

c. means subsequent to said wetting means for orienting the moving wetted flock of the fabric in a predetermined design while in said single plane, said means comprising a plurality of flexible beaters disposed across the width of the fabric and contacting means for bringing the beaters in a whip-like manner into continuous and rapid contact with the flocked side of the moving plane of fabric, said flexible beaters comprising two components, the first component being a flexible connecting member capable of whip-like action, the second component being a flock contacting member shaped in a preselected design, said second component being attached to one end of the connecting member and the other end of the connecting member being secured to the contacting means; and d. means subsequent to said orienting means for drying the wetted fabric to set said flock in said predetermined design pattern.

2. The apparatus of claim 1 wherein the contacting means comprises a driven roll rotatably mounted above and across the fabric in the widthwise direction.

3. The apparatus of claim 1 further comprising a widthwise series of radial brushes rotatably mounted in spaced-apart relationship to one another, said brushes being positioned between said orientation means and said wetting means, along a line parallel to said beaters and in contact with said fabric; and wherein the beaters have a flat flock-contacting edge, the width of which is equivalent to the opposing space created by said brushes.

* * * * *